United States Patent [19]

Cain

[11] 4,169,553

[45] Oct. 2, 1979

[54] BOX CONSTRUCTION WITH STRENGTHENED LID CLOSURE

[76] Inventor: Selwyn H. Cain, 280 Boylston St., Chestnut Hill, Mass. 02167

[21] Appl. No.: 910,213

[22] Filed: May 30, 1978

[51] Int. Cl.[2] ..... B65D 5/64; B65D 43/00; B65D 5/26

[52] U.S. Cl. ..... 229/43; 229/32; 229/35

[58] Field of Search ..... 229/32, 35, 6 A, 43

[56] References Cited

U.S. PATENT DOCUMENTS

| | | | |
|---|---|---|---|
| 2,147,676 | 2/1939 | Shoemaker | 229/35 |
| 2,155,450 | 4/1939 | Shoemaker | 229/35 X |
| 2,349,364 | 5/1944 | Marshall, Jr. | 229/6 A |
| 2,633,285 | 3/1953 | Kells | 229/6 A |
| 3,093,291 | 6/1963 | Brandle | 229/35 |
| 3,393,859 | 7/1968 | Giummo | 229/35 |

*Primary Examiner*—Davis T. Moorhead
*Attorney, Agent, or Firm*—Wolf, Greenfield & Sacks

[57] ABSTRACT

A heavy duty box and blank for forming the box includes structure to increase the strength of the corner regions of the box so that they may provide direct and additional support for the downwardly depending skirt of the cover for the box. The box includes, at each corner, an outwardly projecting tab which is located to provide additional support for the lower edge of the corner region of the skirt of the cover. The invention avoids the necessity of using a cover having a full length skirt and results in a box which better withstands vertical loads, as when other boxes are stacked on top of it.

1 Claim, 6 Drawing Figures

BOX CONSTRUCTION WITH STRENGTHENED LID CLOSURE

BACKGROUND AND SUMMARY OF THE INVENTION

This invention relates to boxes or cartons of the type used to carry heavy loads and, more particularly, to boxes of that type which are intended to be stacked one on top of the other. For example, boxes of this type may be used to pack and ship fish and it is not uncommon for a single box to contain between 100 to 150 pounds of fish. Typically, after a box is filled and its cover in place, another similarly loaded and covered box will be stacked on the first box, as will be subsequently filled boxes. As a result, the lower boxes in the stack may be under a very substantial load. In order to be able to support the load, such boxes typically are formed from very heavy material and often are provided with covers having full length skirts which extending downwardly to the bottom wall of the box. The full length skirt provides a measure of additional lateral structural support for the box and, at least as far as the bottom box in the stack is concerned, the lower edge of the skirt may rest directly on the floor and also provide some additional measure of support to the vertically directed weight of the upper boxes in the stack.

It is among the general objects of the present invention to provide an improved box structure in which each box has a projection at each of its four corners which is disposed to support the lower edge of the corner portions of the skirt of the cover. This avoids the necessity for using full length skirts and also enables the load of successively stacked boxes to be transferred to the corner regions of the lower boxes which are the strongest regions of the boxes and are best able to resist the loads. In addition to providing a means to direct a substantial part of the load to the corner regions of the boxes, the invention also enables covers having relatively short skirts to be used which results in a less expensive box structure.

DESCRIPTION OF THE DRAWINGS

The various objects and advantages of the invention will be appreciated more fully from the following further description thereof, with reference to the accompanying drawings wherein.

DESCRIPTION OF THE PREFERRED EMBODIMENT

Figure 1:
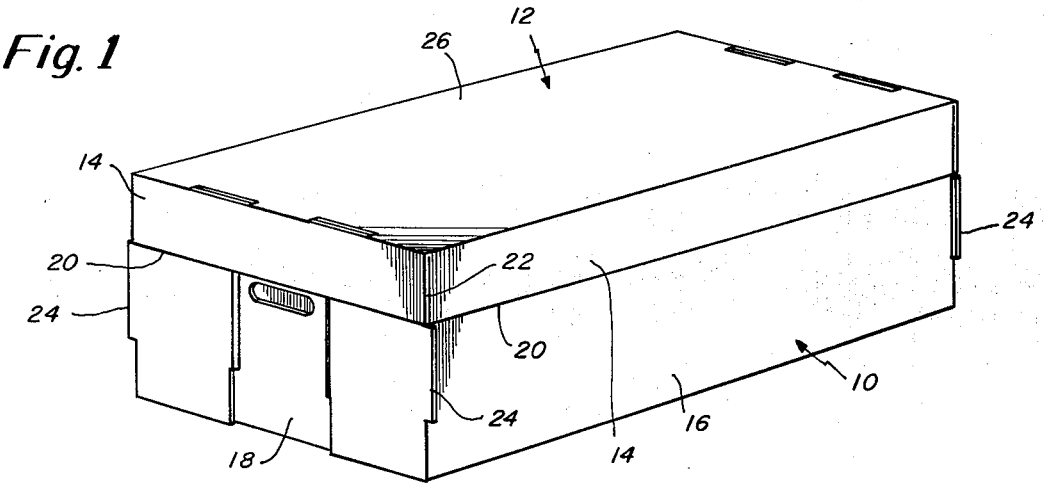
FIG. 1 is a perspective view of a box and cover embodying the invention.

As shown in FIG. 1, the box 10 is of generally rectangular configuration and has a cover 12. Both the box 10 and cover 12 are formed from a heavy duty material, such as heavy corrugated cardboard so that the box may be able to carry very substantial loads, such as of the order of 100 to 150 pounds of fish or the like. When used to package fish, it may be desirable to coat the surfaces of the box with an appropriate water-proof material such as a thin film of polyethylene or wax or the like.

The cover 12 has a downwardly extending skirt 14 about its periphery which, when the cover is in place, surrounds the upper regions of the sidewalls 16 and end walls 18 of the container 10. It should be noted that in the illustrative embodiment, the skirt 14 is comparatively short and does not extend fully downwardly to the bottom of the box, as has been a common prior practice with such containers. Rather, the lower edge 20 of the skirt 14, particularly at its corner region 22 rests on the upper, shoulder-like end of a projection 24 which extends outwardly from each corner region of the box 10. The depth of the skirt 14 is such that when the cover 12 is in place, the inner surface of the top wall 26 of the cover 12 will rest on the upper edge of the side and end walls 16, 18 of the box at the same time as the lower edge 20 of the skirt rests on the shoulder defined by the projection 24. As will be described, this enables a substantial part of the load of boxes stacked on the container to be taken up by the corner regions of the boxes which display increased strength as a result of the projections.

Figure 2:
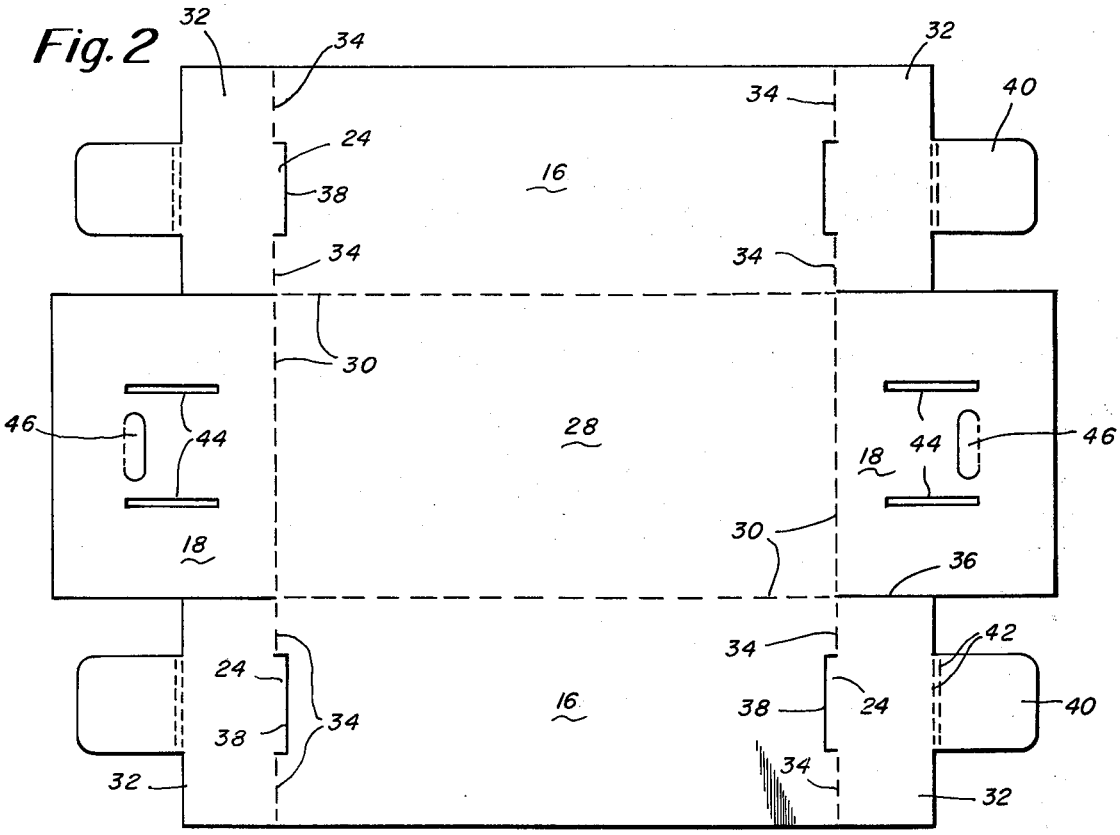
FIG. 2 is a plan view of a blank from which the box may be assembled.

FIG. 2 shows a blank from which the box 10 may be formed. The blank may be die cut from suitable sheet material in accordance with well known die cutting practices. The blank includes a central, bottom wall panel 28, a pair of sidewall panels 16 on opposite sides of the bottom wall panel 28 and a pair of end wall panels 18 on the opposide ends of the bottom wall panel 28. Score lines 30 preferably are formed along the blank to define the panels 16, 18, 28 and to facilitate folding the blank into the box configuration.

Each end of each sidewall panel 18 has an end flap 32 which is defined by and is foldable along a fold line 34 which may be scored into the blank. The end flaps 32 are separated from the end wall panels 18 by a cut 36 which is in line with the longitudinally extending fold lines. The cut 36 terminates at the corner region defined by the fold lines 30, 34. The score line 34 is not continuous but, instead, is interrupted by a relatively wide U-shaped cut 38 which defines the projection 24. As will be described, when the box is folded to its assembled configuration, the projection 24 will extend outwardly from the corner of the box and the U-shaped cut 38 also will define a locking slot to enable the box to be secured in its assembled configuration.

The blank also includes a locking tab 40 which is integral with and extends from the end of each end flap 32. A pair of parallel score lines 42 preferably are formed at the juncture of the end flaps 32 and locking tab 40. As will be described, the locking tabs 40 are received in slots 44 formed in the end wall panels 18. In addition, the end wall panels may be formed to include partially cut handle knockouts 46.

Figure 3:
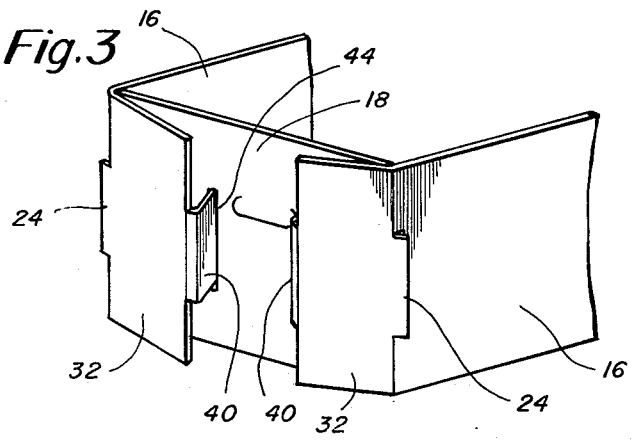
FIG. 3 is an illustration of an end of the box during assembly from the blank of FIG. 2.
Figure 4:
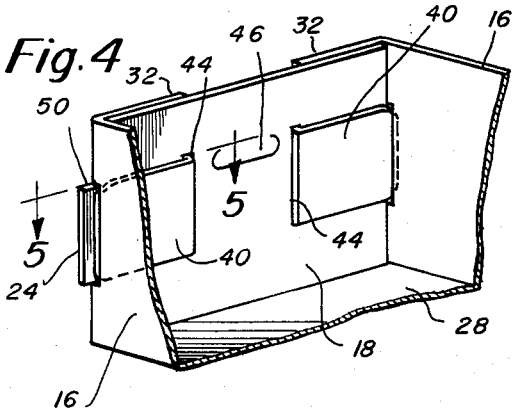
FIG. 4 is a broken away illustration of an assembled end of the box as seen from the inside thereof.
Figure 5:
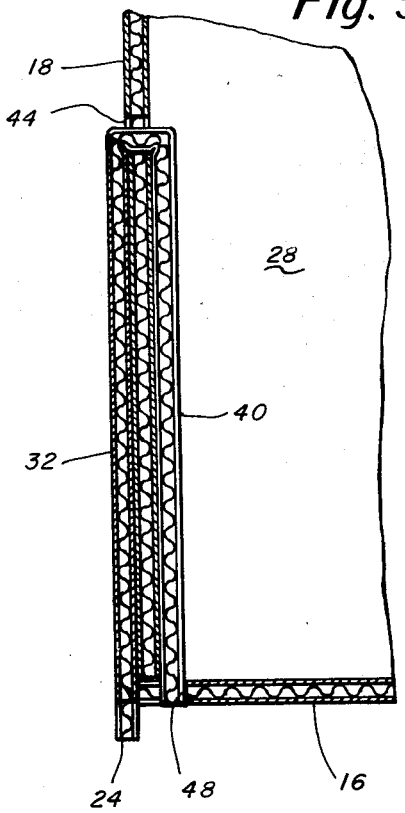
FIG. 5 is an enlarged sectional illustration of a corner region of the box as seen along the line 5—5 of FIG. 4.

The blank is assembled into the container configuration by bending the end wall panels 18 to an upright configuration and then bending the sidewall panels 16 to an upright configuration. The end flaps 32 then are bent along the score lines 34 (which then are vertical) to cause the end flaps 32 to wrap around the raised end walls 18. As the end flaps 32 are wrapped about the end walls 18, their locking tabs 40 are inserted through the slots 44 as suggested in FIG. 3, so that the tabs 40 project into the interior of the box. When the end flaps 32 are folded about the end walls 18, the projection portions 24 swing out of the plane of the sidewalls 16 thus leaving a locking slot 48 (see FIG. 5). In addition, the projections 24 extend outwardly beyond the perimeter of the box so that each may define a shoulder 50 at its upper end. The box is locked in this erected configuration by continuing to fold the locking tabs 40 flat against the inner surface of the end wall 18 to cause the outermost tip of each locking tab 40 to snap into its associated locking slot 48. In this regard, it may be noted that the height of the U-shaped cut 38 (and the locking slot 48 defined thereby) is substantially the same as the width of the locking tab 40.

Figure 6:
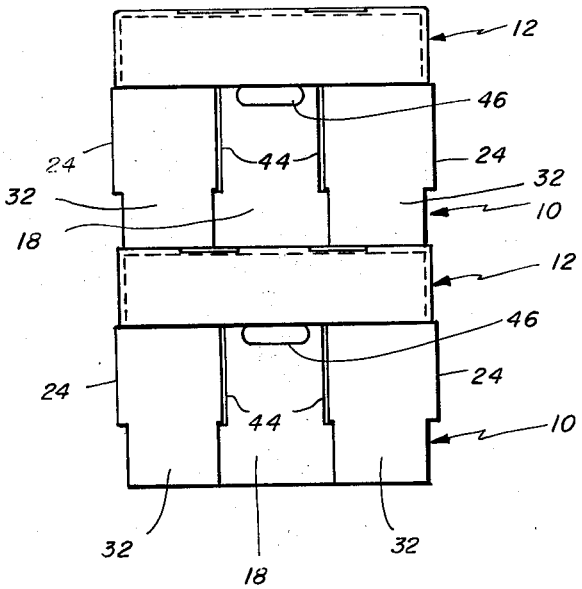
FIG. 6 is an end view of a pair of stacked boxes incorporating the present invention.

The location of the U-shaped slot 38 and, particularly, the end thereof which will define the shoulder portion 50 of the projection 24, is selected with consideration of the inside height of the skirt 14 of the cover 12 which is to be used with the box. Thus, as suggested in FIG. 1, the distance between the upper edge of the box walls and the shoulder 50 is substantially equal to the internal height of the skirt 14. This assures that the shoulder 50 will bear a portion of any load applied to the box cover, such as from other boxes stacked on top, as shown in FIG. 6.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A box and a cover therefor comprising:

said box being formed from a blank having a generally rectangular wall panel and a pair of sidewall panels attached to and extending from the sides of the bottom wall panel;

the blank having a pair of end wall panels attached to and extending from the ends of the bottom wall panel, the blank having fold lines defining said panels from each other;

the blank having an end flap attached to each end of each side wall panel, each end flap being defined in part by an end flap fold line which extends in a direction in line with the fold line between the bottom panel and an associated end wall panel, said end flap fold line being interrupted by a U-shaped cut which extends from said end flap fold line into a portion of the side wall panel associated with said end flap;

the free end of each end flap having a locking tab projecting therefor;

each of the end wall panels having a pair of slots formed therein and receiving the locking tabs when the blank is erected into its box configuration;

said U-shaped cut being constructed and arranged so that the end flaps may overlie the end walls and the U-shaped cut defining a locking opening in which the ends of its associated locking tab are received;

that portion of the box which is defined by the U-shaped cut remaining attached to its associated end flap and projecting outwardly from the corner of the box, said projection terminating, at its upper end, in a shoulder disposed below the upper edge of the walls of the box;

said cover having a top wall and a downwardly surrounding skirt adapted to rest on and surround the upper end of the container;

the height of the skirt and the heightwise location of the shoulder formed by the projection being substantially equal whereby the lower edge of the skirt, at the corner regions, may rest, at least partly on said shoulders.

* * * * *